US006412975B1

(12) United States Patent
Schuchardt et al.

(10) Patent No.: US 6,412,975 B1
(45) Date of Patent: Jul. 2, 2002

(54) STATIC MIXER

(75) Inventors: Heinrich Schuchardt, Leverkusen; Klemens Kohlgrüber, Kürten, both of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/369,212

(22) Filed: Aug. 5, 1999

(30) Foreign Application Priority Data

Aug. 20, 1998 (DE) ..... 198 37 671

(51) Int. Cl.[7] ..... F28D 1/04; B01F 5/06

(52) U.S. Cl. ..... 366/337; 165/148

(58) Field of Search ..... 366/336, 337, 366/339, 340; 165/102, 54, 56, 148, 152, 151, 155, 164, 166, 167, 172, 175, 176

(56) References Cited

U.S. PATENT DOCUMENTS

| | | | | | |
|---|---|---|---|---|---|
| 1,436,379 | A | * | 11/1922 | Chapman | 366/336 |
| 1,655,971 | A | * | 1/1928 | Pflug | 165/148 |
| 2,809,018 | A | * | 10/1957 | Broman | 366/336 |
| 2,839,275 | A | * | 6/1958 | Shaw | 165/175 |
| 2,877,000 | A | * | 3/1959 | Person | 165/148 |
| 3,240,268 | A | * | 3/1966 | Armes | 165/167 |
| 3,682,443 | A | * | 8/1972 | Upmeier | 366/336 |
| 3,871,624 | A | * | 3/1975 | Huber et al. | 366/336 |
| 4,062,524 | A | | 12/1977 | Brauner et al. | 366/340 |
| 4,314,606 | A | | 2/1982 | Müller et al. | 165/163 |
| 4,488,920 | A | * | 12/1984 | Danis | 156/155 |
| 5,803,600 | A | | 9/1998 | Schubert et al. | 366/337 |

FOREIGN PATENT DOCUMENTS

| | | |
|---|---|---|
| DE | 28 39 564 A1 | 3/1980 |
| EP | 0 074 570 A2 | 3/1983 |
| EP | 0 412 177 A1 | 2/1991 |

* cited by examiner

*Primary Examiner*—Tony G. Soohoo
(74) *Attorney, Agent, or Firm*—Norris McLaughlin & Marcus

(57) ABSTRACT

A heatable and coolable static mixer comprising at least two adjacently arranged layers of bars, wherein the bars of neighboring layers cross one another and are interconnected at the crossing points and wherein the layers of bars have heat transfer ducts passing through them at the crossing points.

14 Claims, 10 Drawing Sheets

STATIC MIXER

A description is given of a heatable or coolable, static mixer insert and a heatable or coolable, static mixer having at least one mixer insert, in which the mixer insert is made up at least of two or more adjacently arranged layers of bars, in particular parallel to one another, the bars of respectively neighboring layers of bars crossing one another and the bars being interconnected at the crossing points of the layers of bars, and in which the layers of bars are passed through at the crossing points by heat transfer ducts.

BACKGROUND OF THE INVENTION

For the mixing of liquids, static mixers often are used: in such mixers, a pump forces the liquid through a tube provided with static mixer internals, the liquid being sheared at the mixer and divided into part streams, which are to be mixed with one another.

The following two devices are mentioned as examples of static mixers.

In the case of the so-called Kenics mixers (see "Mischen beim Herstellen and Verarbeiten von Kunststoffen" [mixing in the preparation and processing of plastics], published by VDI Ges. Kun ststofftechnik, VDI-Verlag 1986, pages 238–241), the liquid flow of the product to be mixed is divided into part streams by a separating plate fitted in the tube. This separating plate is twisted about the tube axis. In each of the part streams of the liquid, a turbulent flow is produced, which leads to the liquid being redistributed in the cross section of the tube. A plurality of such mixing elements are in practice arranged one behind the other in order to keep re-dividing the liquid and to achieve an adequate mixing result. The pressure stability of these mixers with respect to high-viscosity fluids is, however, comparatively low.

The so-called SMX mixers (cf. U.S. Pat. No. 4,062,524) comprise two or more mutually perpendicular grids of parallel sheet-metal strips, which are welded to one another at their crossing points and are set at an angle with respect to the main direction of flow of the product to be mixed, in order to be able to divide and mix the liquid. The manufacturing effort for these mixers is relatively high because of the many weld connections to be made.

The heat exchange of high-viscosity liquids on passing through known heat exchangers typically takes place at a very low Reynolds number. If smooth tubes are used for example for the heat exchange, for a Reynolds number approaching zero the heat exchange rate is extremely low and, as far as the heat exchanger is concerned, at a given throughput is essentially dependent only on the length of tube used. A major improvement in the heat exchange is then possible by a combination of the tubular heat exchanger with a static mixing device.

This combination is known in two forms. On the one hand, static mixing elements may be inserted into the tubes of a tubular heat exchanger. The mixing elements from Kenics are used in particular here. On the other hand, the tubes may be used as elements of a static mixer. This is described for example in German Offenleguagsschrift (German Published Specification) DE-A-2 839 564.

The use of a tubular heat exchanger through which product, flows is ruled out, however, in the case of many chemical processes. If, for example, a polymerization reaction has to be cooled, a higher degree of polymerization is achieved in a tube with a slower rate of through-flow on account of the higher residence time of the reactands. As a result, the liquid in the tube may be more viscous than in the neighboring tubes. This has the effect that the flow velocity of the product to be mixed is further slowed. With certain process parameters, tubes of a tubular heat exchanger may therefore be clogged by polymerizate.

In the case of such processes, a static mixer formed by heat exchanger tubes, as described in DE-A 2 839 564, is to be preferred. The manufacturing effort for the production of these mixers is so great, however, that this solution is often rejected as uneconomical.

The object of the invention is to provide a static mixer which is coolable or heatable and which can be produced in a comparatively simple way.

The object is achieved according to the invention by the static mixer insert described below and in particular by the static mixer also described.

SUMMARY OF THE INVENTION

The subject-matter of the invention is a static mixer insert comprising at least two or more adjacently arranged layers of bars, in particular parallel to one another, the bars of respectively neighboring layers of bars crossing one another and the bars being interconnected at the crossing points, characterized in that the layers of bars are passed through at their crossing points by heat transfer ducts.

DETAILED DESCRIPTION

The heat transfer ducts preferably run as an angle alpha $\geqq 60°$ with respect to the plane of the layers of bars.

The heat transfer ducts may open out into individual supply lines and discharge lines for a heat transfer medium.

A preferred variant of the static mixer insert is designed in such a way that at least some of the bars are configured as hollow bars, which have additional ducts for a heat transfer medium.

In a preferred configuration of the mixer, the bars are set at an angle, in particular of 30 to 50° or of −30 to −50°, with respect to the main direction of flow of the product to be mixed, whereby a good division of the stream of product to be mixed into part streams is brought about.

In a variant of the static mixer insert, the heat transfer ducts or the ducts which run through the hollow bars are interconnected in a meandering manner at their inlets and outlets. This results in an assembly of heat transfer medium lines which has only a small number of supply lines and discharge lines for the heat transfer medium.

The subject-matter of the invention is also a static mixer insert comprising at least two or more adjacently arranged layers of bars, in particular parallel to one another, and in particular of rectangular cross section, the bars of respectively neighboring layers of bars crossing one another and the bars being interconnected at the crossing points, characterized in that the bars are configured as hollow bars which have ducts for a heat transfer medium. In this independent configuration, the mixer insert is not passed through at the crossing points by additional heat transfer ducts which run through the layers of bars.

In the case of this form of the static mixer insert as well, the heat transfer ducts may open out individually into supply lines and discharge lines for a heat transfer medium.

In both independent forms of the static mixer inserts, the bars are preferably configured as straight bars.

Likewise, the bars of this constructional form, which are provided only with hollow bars as ducts, may be set at an angle, in particular of 30 to 50° or of −30 to −50°, with respect to the main direction of flow of the product to be mixed.

The heat transfer ducts of this static mixer insert as well may be interconnected in a meandering manner at their inlets and outlets.

Further subject-matter of the invention is a static mixer comprising at least one of the mixer inserts according to the invention mentioned and an inner housing, which encloses the mixer insert and in which there are provided openings for the supply line and discharge line of the heat transfer medium either to the heat transfer ducts crossing the layers of bars or to the ducts running along the bars or to both.

The heat transfer ducts or the ducts of the hollow bars are preferably connected directly to the openings in the inner housing.

A particularly preferred static mixer is constructed in such a way that the inner housing is also enclosed by an additional outer housing, which has at least one inlet connection piece and an outlet connection piece for the heat transfer medium, and forms with the inner housing an inlet space and an outlet space for the heat transfer medium and has an inlet and an outlet for the product to be mixed.

To improve the mixing effect, in a particularly preferred form of the static mixer a plurality of mixer inserts are arranged one above the other in the inner housing and respectively neighboring mixer inserts are arranged such that they are turned with respect to one another about their center axis.

The construction of the static mixer element according to the invention and of the static mixer according to the invention makes it possible for them to be produced by injection moulding of a workpiece which comprises the bars and the inner housing walls penetrated by the heat transfer ducts, in that slides in the injection mould create the intermediate spaces between the bars and the heat transfer ducts. This workpiece may either be fitted itself into an outer housing, for example a pipeline, or serve as a consumable pattern for precision casting.

In a corresponding way, an embodiment is obtained in a simple way by producing a block comprising the bars with the heat transfer ducts by a primary forming process.

In a particularly preferred form, each bar of a layer of bars, apart from at most one bar, ends only at one end of the bar on an inner housing wall, while the other end points into the product stream. This form of construction makes it possible during injection moulding for all the inner housing walls with the bars to be moulded together, since all the intermediate spaces between the bars are accessible for slides. As a result, the joining effort involved in producing the complete mixer is reduced.

In a corresponding way, a manufacturing process in which the part of the inner housing wall that is penetrated by the heat transfer ducts is simultaneously produced in one primary forming process is particularly preferred.

By providing the mixer insert or mixer according to the invention, the heat transfer from the heat transfer medium to the product to be mixed is improved, since the heat conduction paths from the heat transfer medium to the product are shortened.

In a preferred embodiment, a plurality of static mixers, if appropriate also in any combination with known static mixers, are put together to form a mixer module connected in series.

In particular if the successive static mixer inserts are put together such that they are turned through 90° with respect to one another, a particularly good mixing effect is achieved.

On account of the low production effort for the primary forming process, the heatable or coolable static mixers described can be used not only where static mixing is required but may also, from cost aspects, replace other heat exchangers, such as for example tubular heat exchangers as condensers.

The invention is explained in more detail below by way of example on the basis of figures, without thereby restricting specifics of the invention.

EXAMPLES

Example 1

Figure 1A:
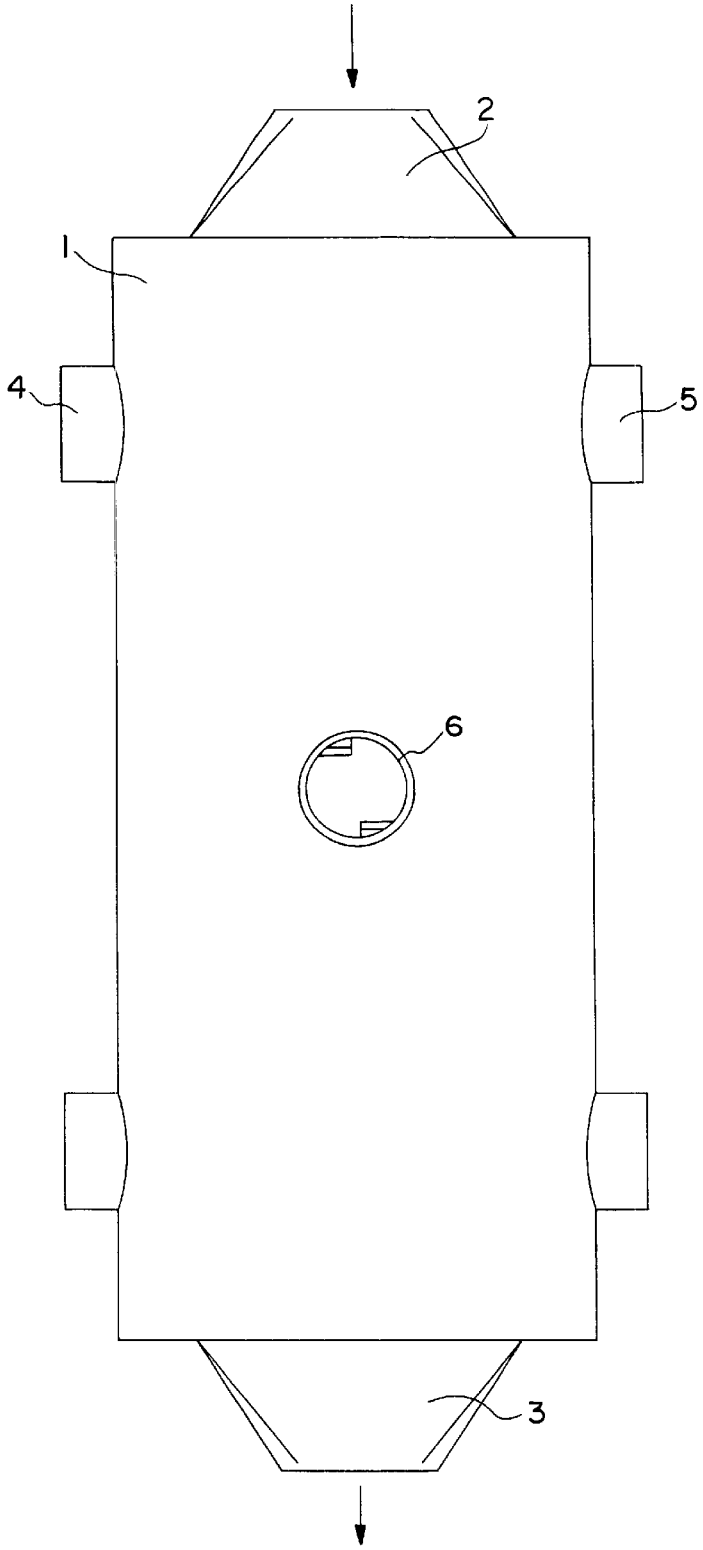
FIG. 1*a* shows the front view of a mixer according to the invention.
Figure 1B:
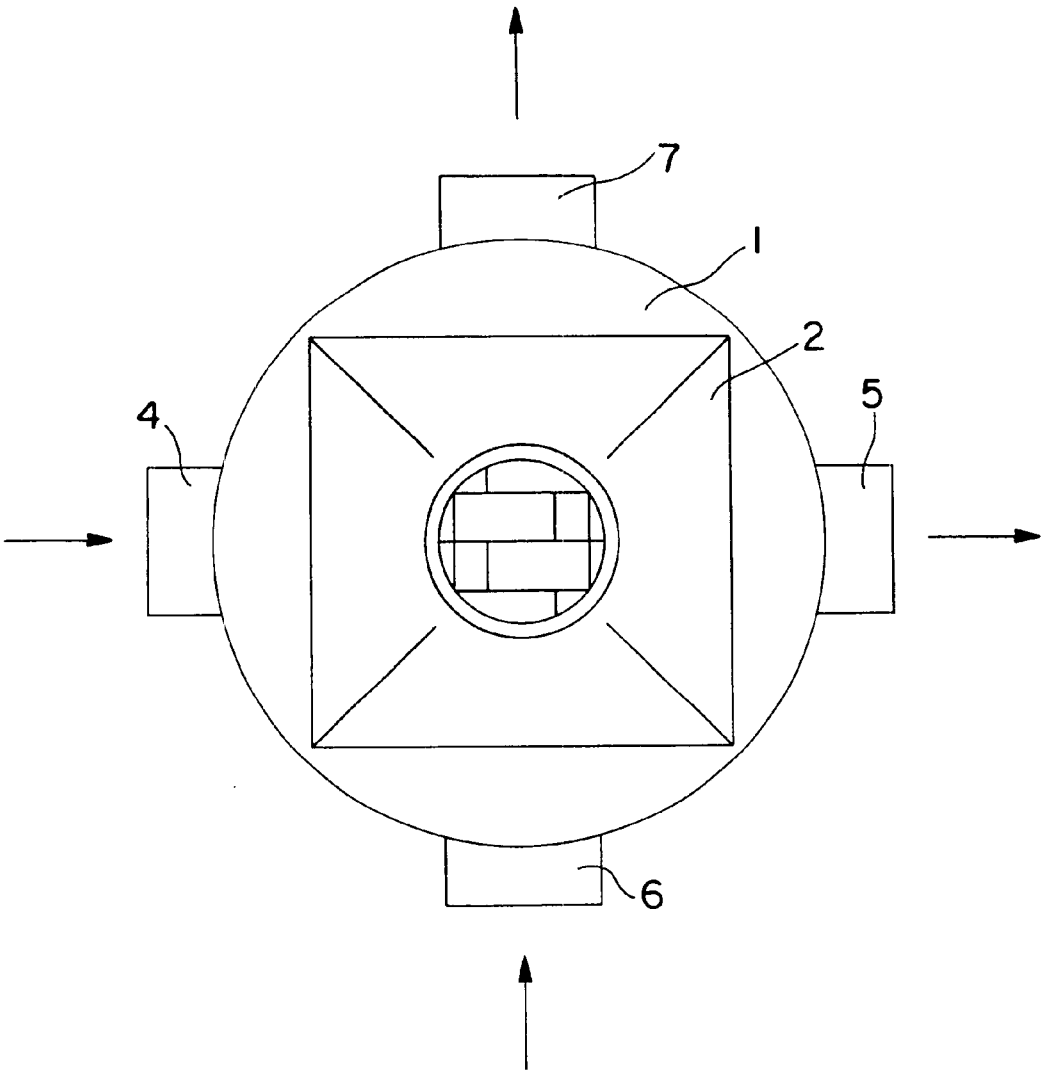
FIG. 1*b* shows the plan view of the mixer from FIG. 1*a*.
Figure 1C:
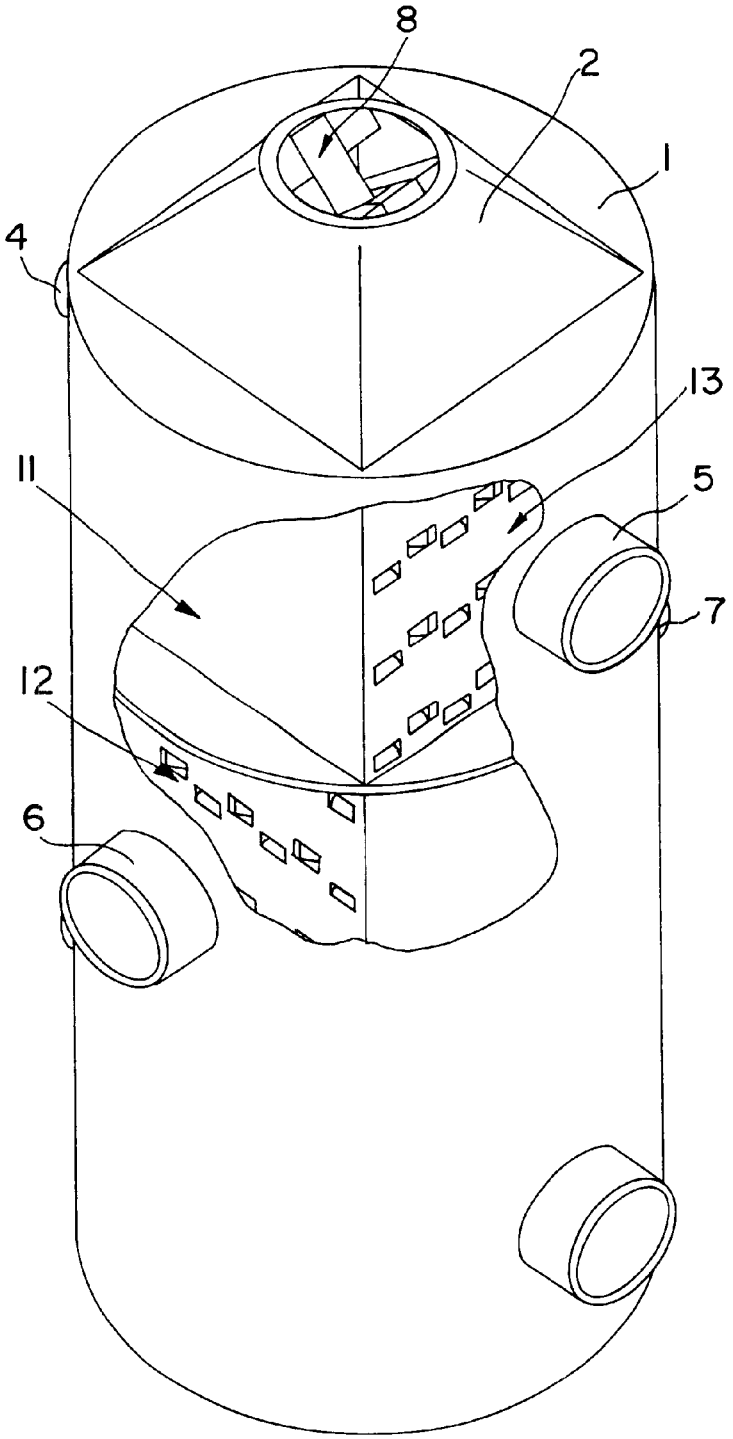
FIG. 1*c* shows the perspective view of the mixer from FIG. 1*a*.

FIGS. 1*a* to *c* show a mixer according to the invention from various views. In these views, the outer housing is represented only schematically. The mixer comprises an outer housing 1 with product inlet connection piece 2, product outlet connection piece 3 as well as inlet connection pieces 4, 6 and outlet connection pieces 5,7 for the heating/cooling medium and the mixer inserts 8, 10 with internal housing 11.

Figure 2:
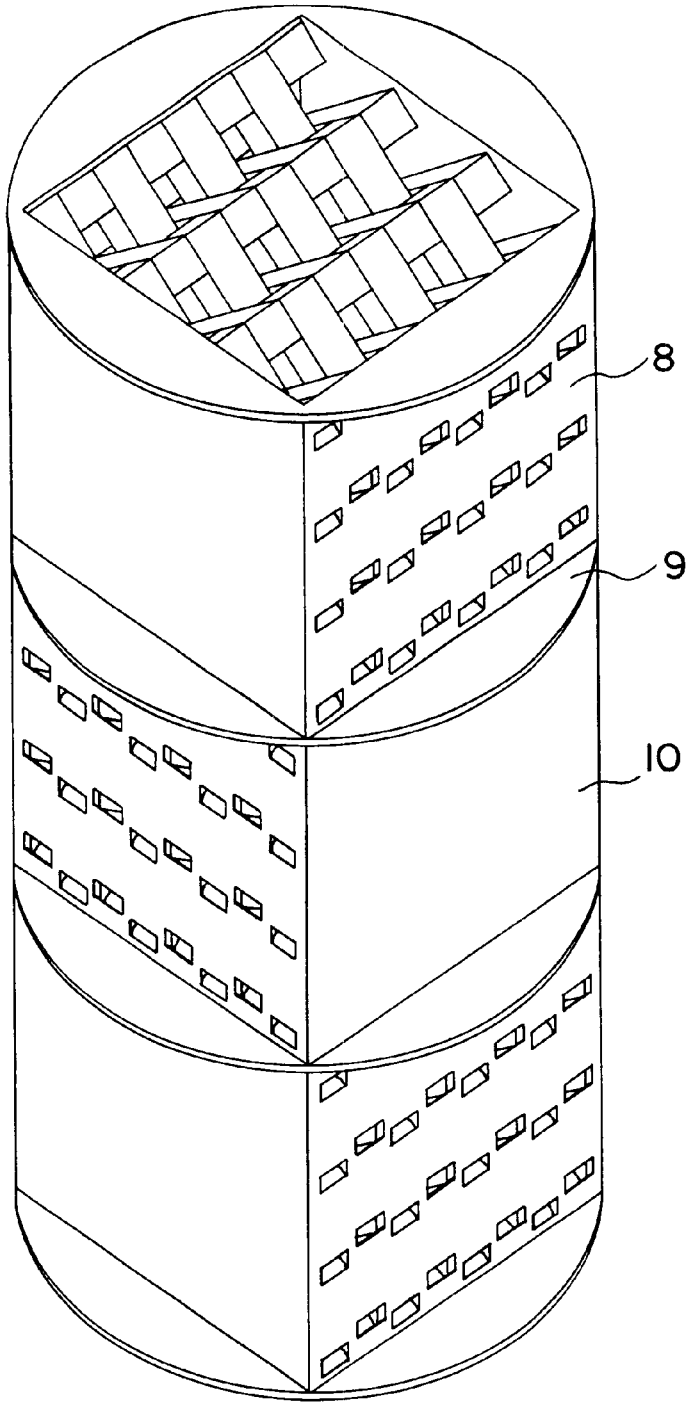
FIG. 2 shows the perspective view of the internals of the mixer from FIG. 1*a*.

In the interior of the mixer there are the internals represented in FIG. 2, comprising mixing elements 8, 10 which are set one above the other such that they are respectively turned through 90° with respect to one another and are separated from one another on the temperature control medium side by separating plates 9, in order to control the direction of flow of the temperature control medium. With a different arrangement of the separating plates, the number of heating/cooling medium connection pieces may be reduced, at the expense of a greater pressure loss.

Figure 3A:
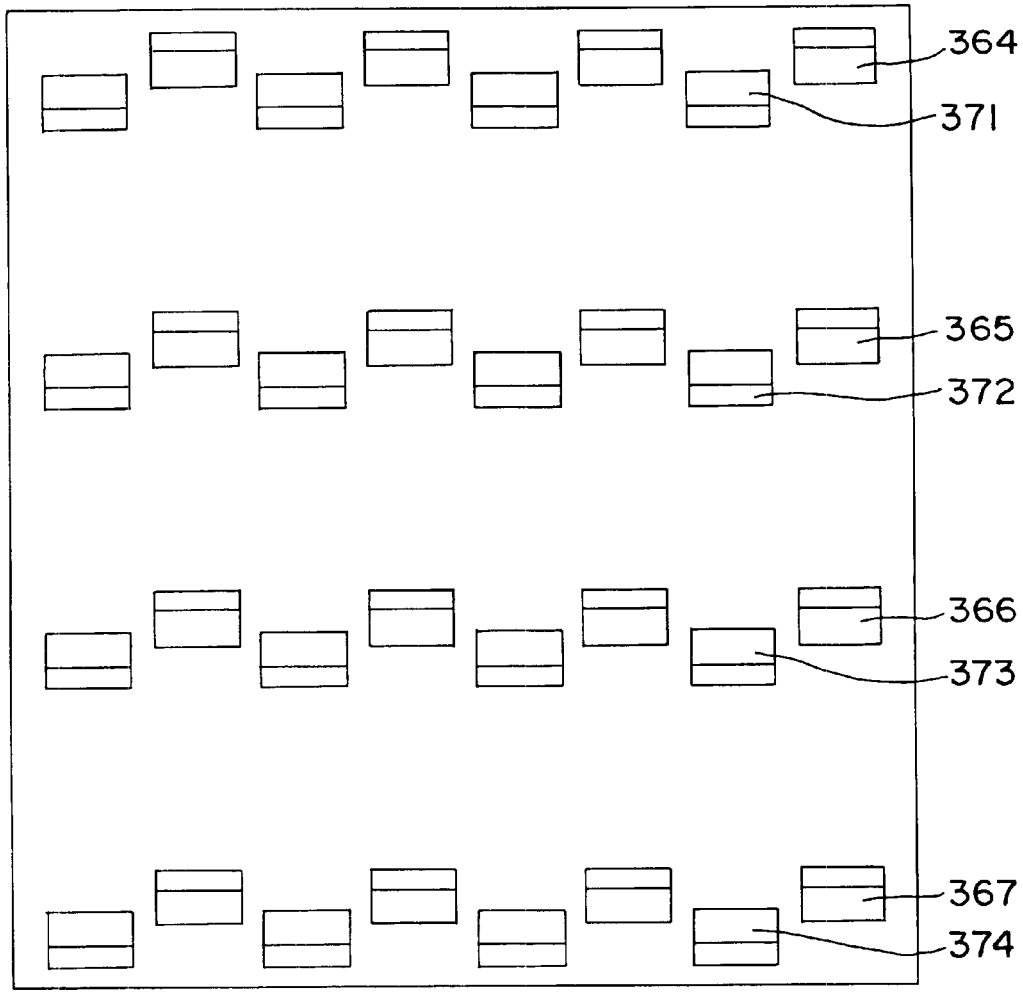
FIG. 3*a* shows the front view of a mixing element of the mixer from FIG. 1*a*.
Figure 3B:
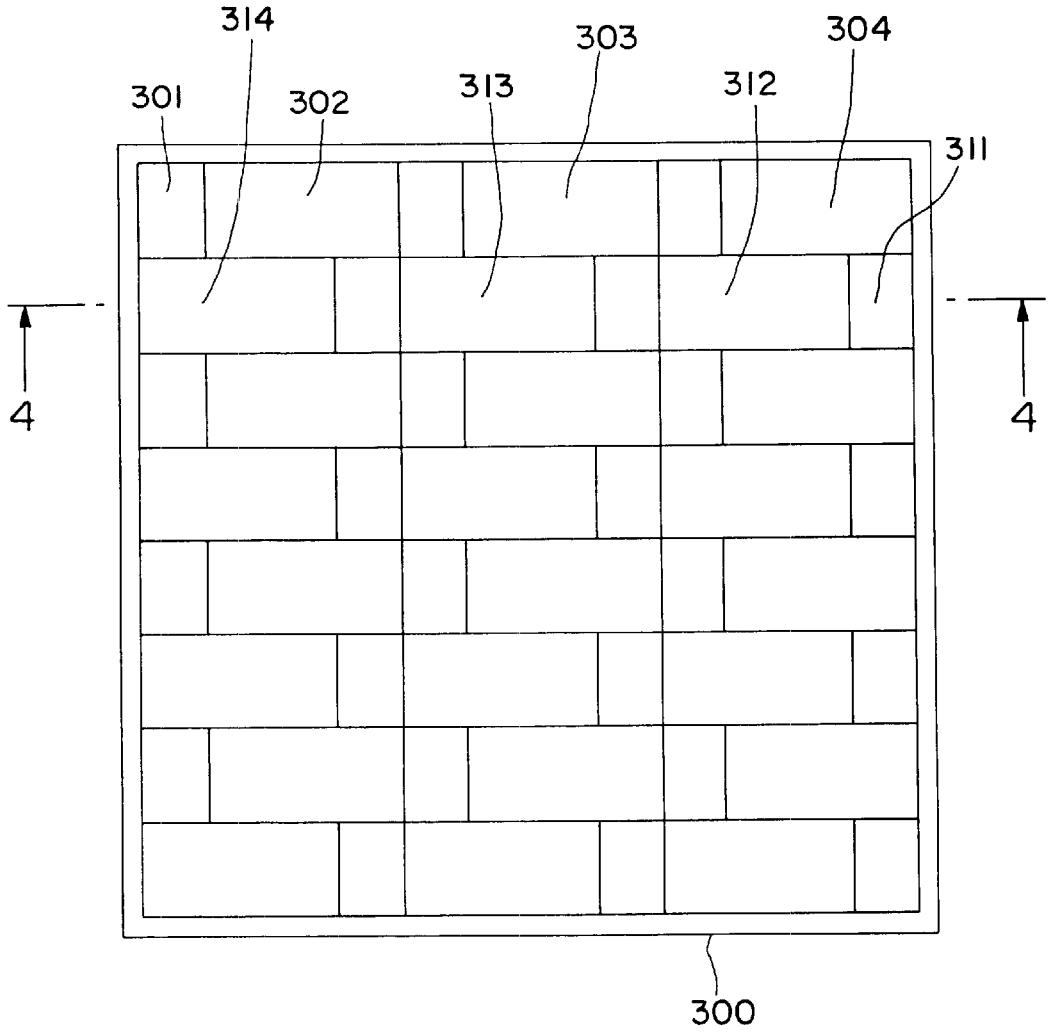
FIG. 3*b* shows the plan view of the mixing element from FIG. 3*a*.
Figure 3C:
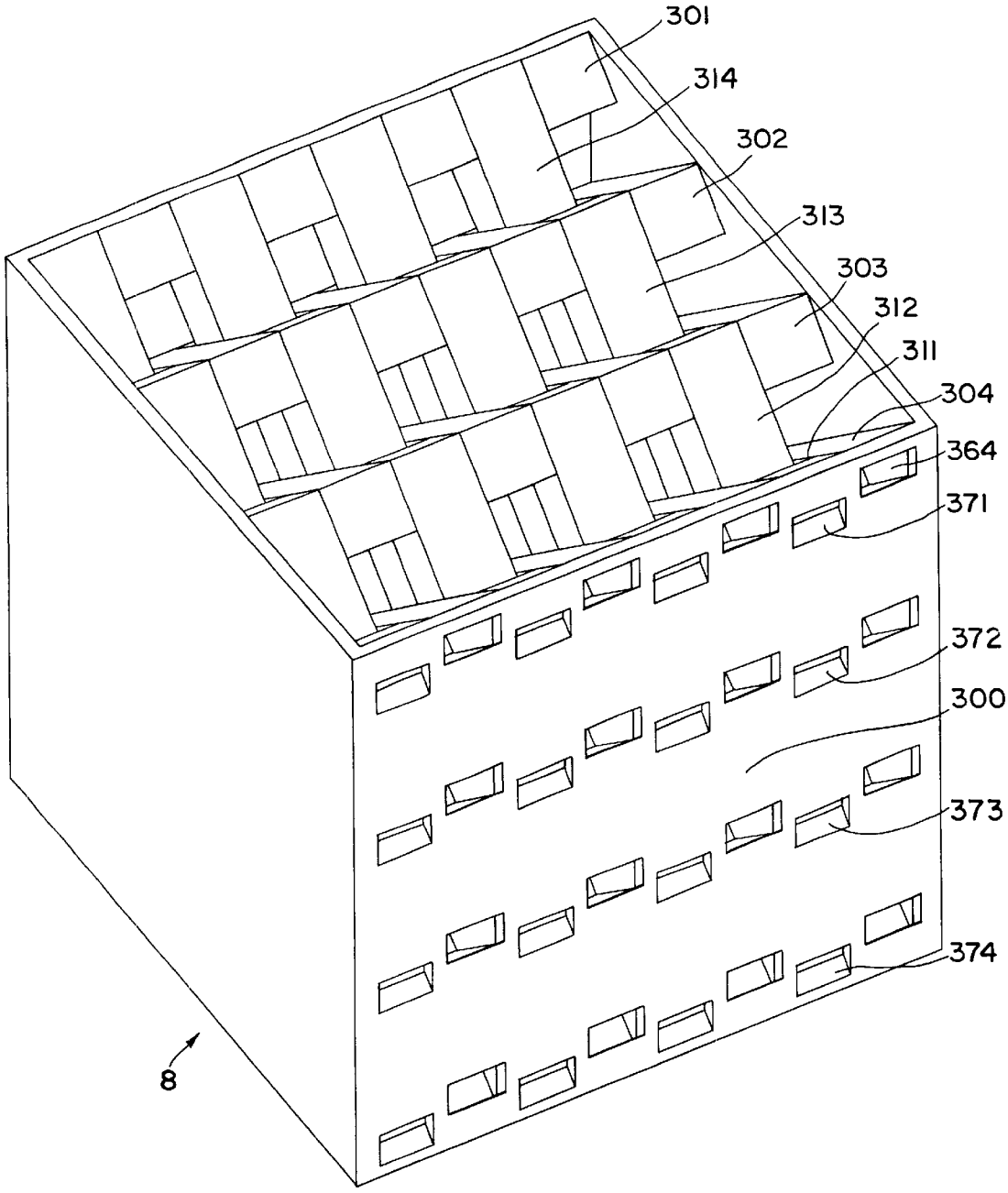
FIG. 3*c* shows the perspective view of the mixing element from FIG. 3*a*.
Figure 4:
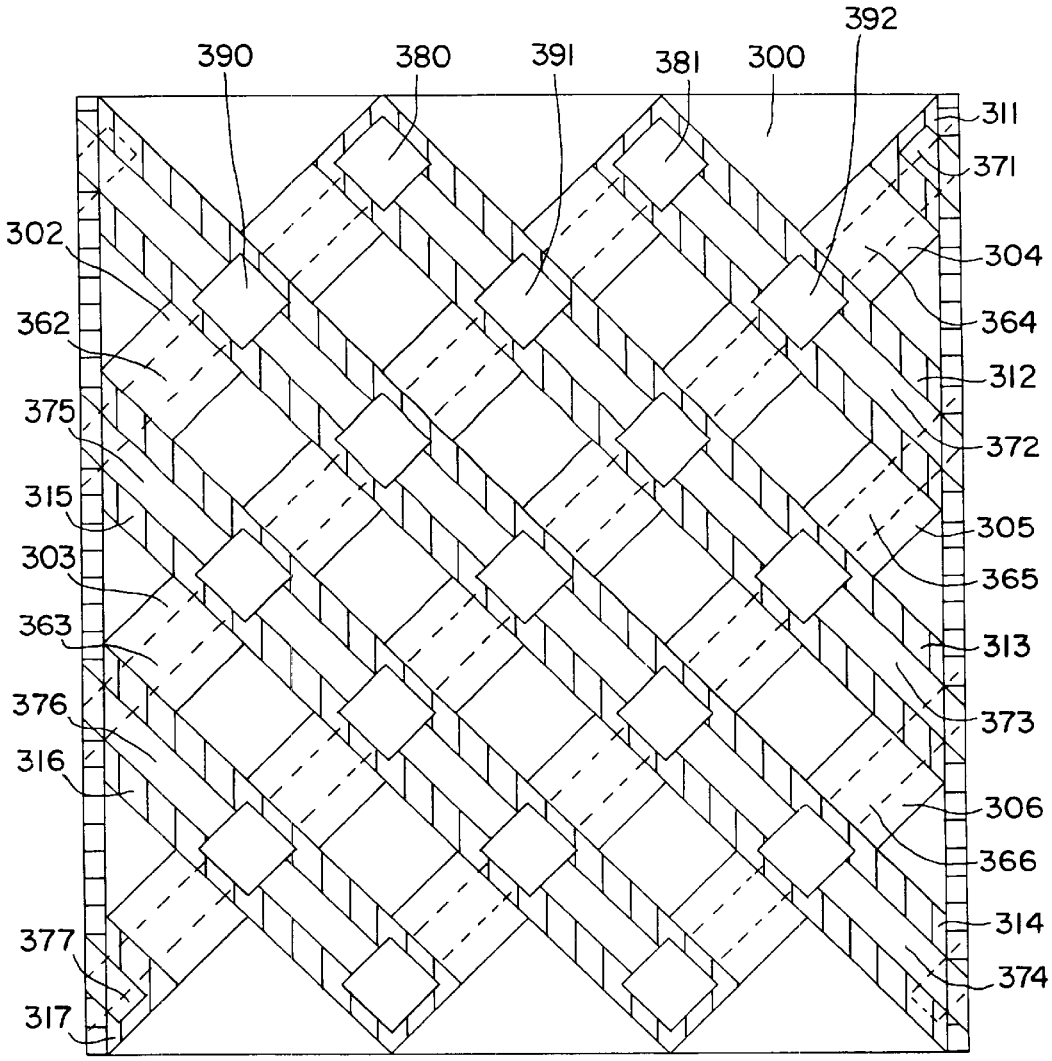
FIG. 4 shows a section through the mixing element from FIG. 3*a* corresponding to the section line 4—4 depicted in FIG. 3*b*.

FIGS. 3*a* to *c* show a mixing element (8) from various views. It comprises the inner housing portion 300 and alternating layers of parallel bars 301–306 and 311–317 respectively (some of which can be seen only in section in FIG. 4). The bars of two successive layers of bars cross at an angle of 90° and are at an angle of 45° with respect to the direction of product flow. The bars are hollow and are passed through by heating/cooling ducts 362–367 and 371–377, respectively (FIG. 4). In order to achieve a flow through the ducts, they are interconnected through by connecting ducts 380, 381, 390, 391,392 crossing the layers of bars (see the section in FIG. 4). Of each layer of bars 301–306, 311–317, in each case only one bar 304 and 314, respectively, reaches from one housing inner wall to the opposite inner wall. All the other bars have one free end.

Example 2

Figure 5:
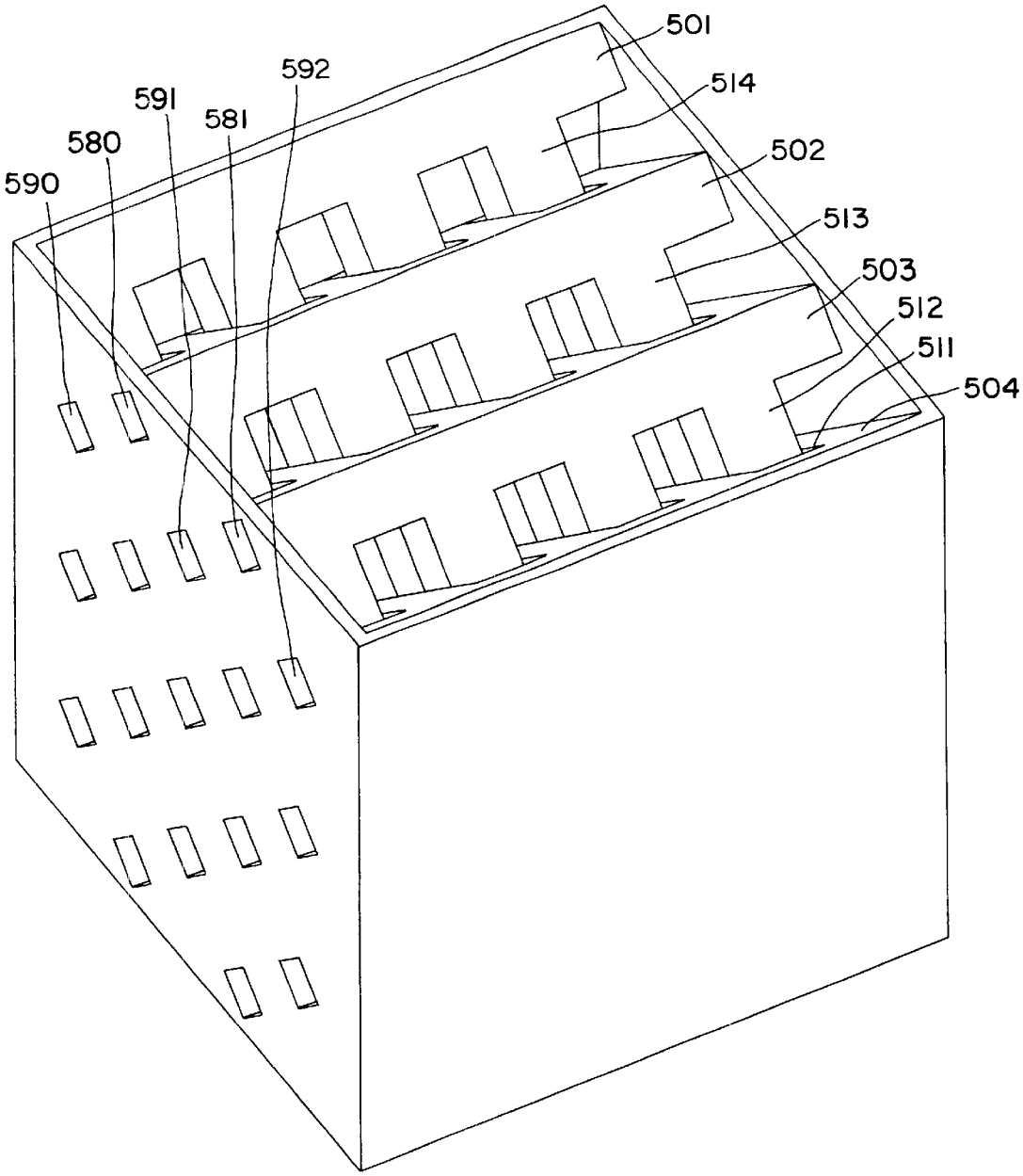
FIG. 5 shows the perspective view of a mixing element without heating/cooling ducts in the direction of the bars.

FIG. 5 shows an alternative construction of a mixing element, as can be used in a mixer according to the invention. The heating/cooling ducts along the bars have been dispensed with so as to simplify production, and instead the cooling ducts 580–592 crossing the layers of bars reach through the inner housing of the mixing element.

Such a mixing element is suitable in particular for high-viscosity products, in which the main thermal resistance is on the product side and the additional thermal resistance due to heat conduction in the then solid bars is not significant.

Figure 6:
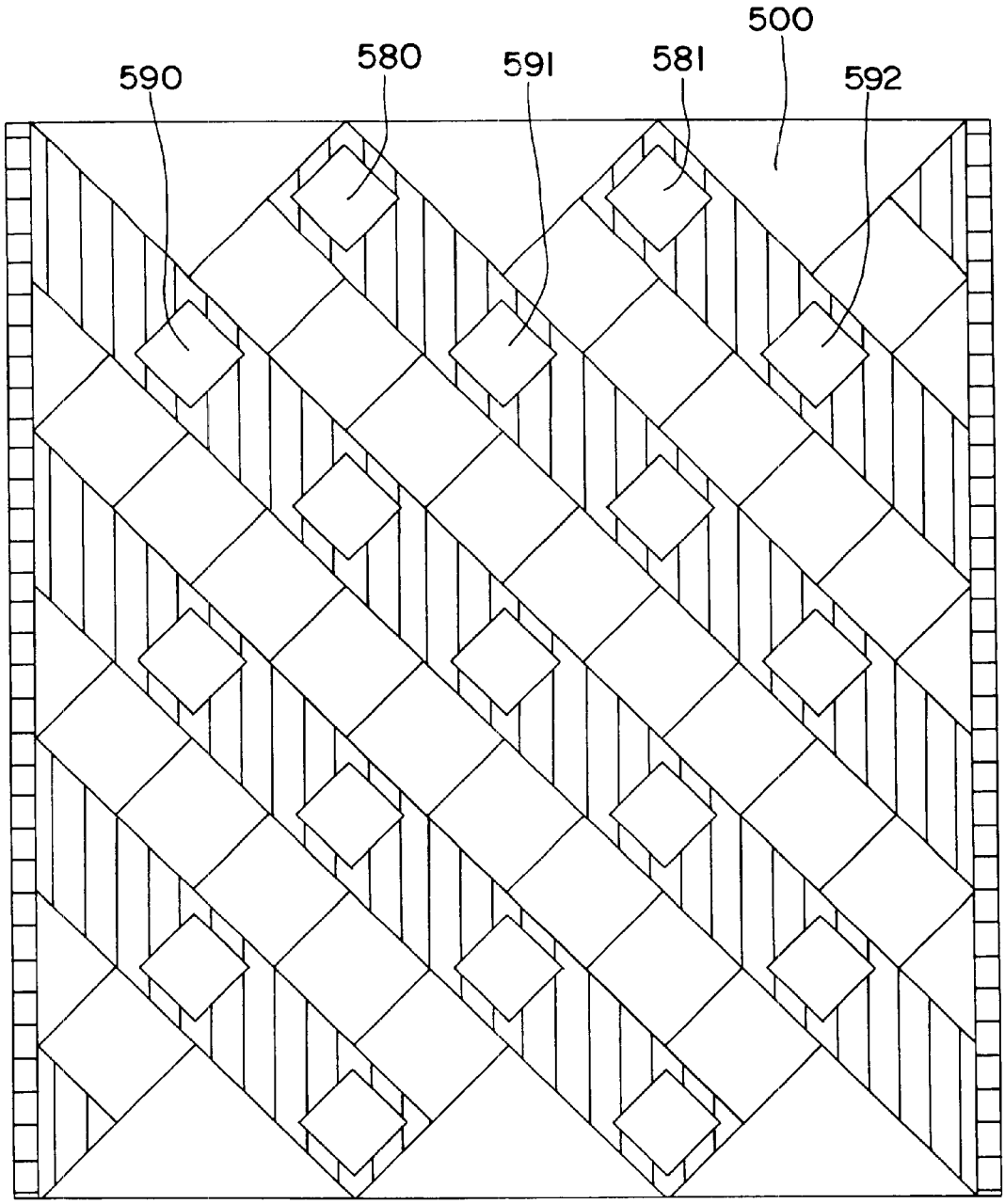
FIG. 6 shows a section through the mixing element from FIG. 5 analogous to the section line 4—4 from FIG. 3*b*.

FIG. 6 shows a section through the mixing element according to Figure analogous to the section 4—4 from FIG. 3*b*.

What is claimed is:

1. Static mixer insert comprising at least two adjacently arranged layers of bars, wherein the bars of neighboring layers of bars cross one another and are interconnected at the crossing points, and wherein the layers of bars have ducts for heat transfer medium passing through them at the crossing points.

2. Static mixer insert according to claim 1, wherein at least some of the bars are configured as hollow bars which have additional ducts for heat transfer medium.

3. Static mixer according to claim 2, wherein the heat transfer ducts or the additional ducts have inlets and outlets and are interconnected.

4. Static mixer comprising at least one mixer insert according to claim 2, and an inner housing which encloses the mixer insert and in which there are provided openings for a supply line and a discharge line for heat transfer medium to the heat transfer ducts or the additional ducts.

5. Static mixer according to claim 4, wherein the heat transfer ducts or the additional ducts are connected directly to openings in the inner housing.

6. Static mixer according to claim 4, wherein the inner housing is enclosed by an additional outer housing, which has at least one inlet connection piece and an outlet connection piece for the heat transfer medium, and forms with the inner housing an inlet space and an outlet space for the heat transfer medium and has an inlet and an outlet for the product to be mixed.

7. Static mixer according to claim 4, wherein a plurality of mixer inserts are arranged one above the other in the inner housing and respectively neighboring mixer inserts are arranged such that they are turned with respect to one another about their center axis.

8. Static mixer according to claim 4, wherein each bar of a layer of bars ends only at one end of the bar on an inner housing wall.

9. Static mixer according to claim 1, wherein the bars are configured as straight bars.

10. Static mixer insert according to claim 9, wherein the crossing bars are disposed at a crossing angle of 60° to 100° with respect to each other.

11. Static mixer insert comprising at least two adjacently arranged layers of bars, the bars of neighboring layers of bars crossing one another and being interconnected at the crossing points and configured as hollow bars which have ducts for a heat transfer medium.

12. Static mixer according to claim 7, wherein the bars are configured as straight bars.

13. Static mixer insert according to claim 9, wherein the crossing bars are disposed at a crossing angle of 60° to 100° with respect to each other.

14. Static mixer according to claim 11, wherein the heat transfer ducts have inlets and outlets and are interconnected.

* * * * *